United States Patent [19]

Geymond

[11] 3,994,754

[45] Nov. 30, 1976

[54] HIGH ELASTIC-LIMIT, WELDABLE LOW ALLOY STEEL

[75] Inventor: Robert H. Geymond, Pont de Briques, France

[73] Assignee: Societe des Acieries de Paris & d'Outreau, Paris, France

[22] Filed: July 7, 1975

[21] Appl. No.: 593,297

[30] Foreign Application Priority Data

July 8, 1974 France ..... 74.23629
June 24, 1975 France ..... 75.19711

[52] U.S. Cl. ..... 148/36; 75/124; 75/128 A; 75/128 G; 75/128 T; 75/128 W; 75/128 V

[51] Int. Cl.[2] ..... C22C 38/06; C22C 38/24; C22C 38/26; C22C 38/28

[58] Field of Search ..... 148/36; 75/124, 128 A, 75/128 W, 128 G, 128 T, 128 V

[56] References Cited

UNITED STATES PATENTS

| | | | |
|---|---|---|---|
| 3,216,823 | 11/1965 | Gulya et al. | 148/36 X |
| 3,402,080 | 9/1968 | Kubota et al. | 148/36 |
| 3,834,949 | 9/1974 | Heitmann et al. | 75/128 G X |

*Primary Examiner*—Arthur J. Steiner

[57] ABSTRACT

This invention provides a manganese steel having a high elastic limit and at the same time a good weldability, its composition comprising, in percentage by weight: Carbon, 0.09 to 0.15; manganese, 1.30 to 1.80; molybdenum, 0.15 to 0.35; silicon, 0.10 to 0.40; vanadium, 0.03 to 0.06; niobium or tantalum 0.005 to 0.05; aluminum, 0.015 to 0.050; titanium, 0.002 to 0.040; nickel, 0.10 to 0.30; chromium, 0.10 to 0.25; sulfur $\leq$ 0.020 and phosphorus $\leq$ 0.030, the balance to make 100 % consisting essentially of iron; furthermore, this steel has undergone a cycle of heat treatments including a homogenization at high temperature, a water quenching and a tempering, and has a very fine grained micro-structure consisting of bainite and ferrite; the steel thus obtained has a satisfactory weldability and an elastic limit $\geq$ 550 N/mm$^2$, an elastic-limit to tensile strength ration higher than 0.85 and a breaking energy at −50° C measured on a V-notched test bar which is greater than or equal to 20 Joules. This steel is suitable for manufacturing one-piece articles or parts assembled by welding, notably for the manufacture of automatic one-piece or welded couplings for railway cars and wagons.

6 Claims, No Drawings

HIGH ELASTIC-LIMIT, WELDABLE LOW ALLOY STEEL

BACKGROUND OF THE INVENTION

The present invention relates to a high elastic-limit, weldable cast steel to the method of making same and applying thermal treatments thereto, and also to its various applications.

The increasing demand for light-weight metal constructions, notably in transport equipments of all kinds, led manufacturers to search after cast steel grades having a high or improved elastic limit. To produce high elastic-limit steels a manganese content in the range of up to 2%, given a carbon content of 0.25% by weight, is frequently used.

These steel grades, though having higher mechanical properties than ordinary steels, have an elastic limit seldom in excess of 430 N/mm² and a poor weldability, in comparison with certain practical industrial requirements.

SUMMARY OF THE INVENTION

It is the essential object of the present invention to provide a high elastic-limit weldable cast steel characterized in that it contains 0.09 to 0.15% by weight of carbon, 1.30 to 1.80% by weight of Mn, 0.15 to 0.35% by weight of Mo, 0.10 to 0.40% by weight of Si, 0.03 to 0.06% by weight of V, 0.005 to 0.05% by weight of Nb or Ta, 0.015 to 0.050% by weight of Al, 0.002 to 0.040% by weight of T, 0.10 to 0.30% by weight of N, 0.10 to 0.25% by weight of Cr, $\leq$ 0.020% by weight of sulphur and $\leq$ 0.030% by weight of phosphorus, the balance to make 100% by weight consisting chiefly of iron, in that it has undergone a cycle of thermal treatments including a high-temperature homogenization treatment, a quenching treatment in water followed by a tempering step, and that it has a very finely grained micro-structure consisting of low-carbon bainite and ferrite hardened by the presence of finely divided precipitates of complex carbonitrides, notably Mo, V and Nb or Ta carbonitrides, this steel having, in conjunction with a good weldability, an elastic limit 550 N/mm², an elastic limit to tensile strength ratio > 0.85 and a breaking energy $\geq$ 20 joules at −50° C, measured on a V-notched test bar. This invention would still be effective and useful if one or a plurality of the above-mentioned elements from the fifth column of Mendeleieff's Table (V, Nb, Ta) were replaced by one or several other metal elements having the same influence on the steel structure, these elements being selected from the group of rare earths such as germanium.

This specific composition and micro-structure of the cast steel according to this invention impart to said steel high mechanical properties affording an increment in the stress limit and a reduction in the construction weight, the steel remaining nevertheless weldable without requiring any preheating or any subsequent heat treatments.

The above-mentioned elements (V, Nb, Ta) constitute fine precipitates regularly distributed throughout the matrix, thus preventing dislocations, and when these elements are introduced even in low proportions into a steel having a composition similar to that of an ordinary steel they are conducive to high mechanical properties comparable with those obtained with a fairly alloyed steel.

It is another object of the present invention to provide a method of making steel according to this invention by using a cycle of heat treatments. This steel is prepared by melting the mixture of its component elements under conditions suitable for obtaining low impurity contents, notably sulphur and phosphorus, by properly deoxidising the molten mixture and casting this mixture at a temperature in the range of 1,600° to 1,690° C. The method may be carried out in a furnace such as an electric furnace for example of the basic arc or induction type, or according to any other known and suitable metallurgical process (for example a so-called fast metallurgical process) permitting of operating within the above-mentioned temperature range and obtaining, as permitted by the electric furnace, a steel grade characterized by a low impurity content, notably sulphur and phosphorus, and controlled contents of elements such as Al and Ti. High mechanical properties, notably a high elastic limit, and a satisfactory weldability, are imparted by this cycle of heat treatments to the above-defined cast steel. This cycle comprises a high-temperature homogenization treatment, a water quenching and tempering step imparting to the cast steel thus produced a high ductility while maintaining a very high elastic limit. The metal is homogenized by the high-temperature treatment performed at a temperature within the range of 900° to 1,050° C, the temperature increment and temperature maintaining times being of the order of a few hours and depending on the thickness of the steel casting (the necessary treatment temperature must be obtained down to the heart or core of the casting, without creating internal stress therein). Water quenching at room temperature refines the metal grain by causing a bainitic matrix to develop therein while imparting the requisite hardness to the steel. It includes a preliminary heating at a temperature in the range of 875° to 950° C during about one hour, the necessary temperature being attained within a time period of the order of a few hours. The tempering, performed at a temperature in the range of 550° to 680° C, increases the metal ductility (making the metal less brittle and fragile) without substantially impairing its strength (the metal preserving a high elastic limit); the time required for attaining and maintaining these temperatures are of the order of a few hours, the temperature being maintained during a relatively long time period, for example 3 to 5 hr. In the description of the cycle of heat treatments according to this invention the terms "time of the order of a few hours" are to be understood as referring to a time period of 2 to 6 hours. In the case of the annealing and tempering operations, the cooling step following the heating at a fixed temperature takes place in a calm atmosphere.

A further object of the present invention is to provide specific industrial applications of said cast steel, notably for constructing one-piece structures or parts, or welded structures or parts.

A preferred composition of the cast steel according to this invention is as follows, the elements being given as percentage by weight while the balance to make 100% consists of iron:

| | | |
|---|---|---|
| C = 0.09 to 0.15 | Mn = 1.30 to 1.80 | Mo = 0.15 to 0.25 |
| Si = 0.10 to 0.35 | V = 0.03 to 0.05 | Nb = 0.025 to 0.05 |
| S $\leq$ 0.020 | P $\leq$ 0.020 | Al = 0.020 to 0.050 |

-continued

| | | |
|---|---|---|
| Ti = 0.020 to 0.040 | Ni = 0.10 to 0.30 | Cr = 0.10 to 0.35 |

Another composition also providing very satisfactory mechanical properties is as follows (percentages by weight and balance to 100% consisting essentially of iron):

| | | |
|---|---|---|
| C = 0.09 to 0.12 | Mn = 1.45 to 1.60 | Mo = 0.25 to 0.35 |
| Si = 0.25 to 0.40 | V = 0.035 to 0.055 | Nb = 0.005 to 0.015 |
| S ≤ 0.020 | P ≤ 0.030 | Al = 0.015 to 0.035 |
| Ti = 0.002 to 0.010 | Ni = 0.20 to 0.30 | Cr = 0.10 to 0.15. |

The low carbon content is particularly advantageous in the case of a welded construction. The slight increase in the Mn content in comparison with conventional manganese steels is useful for retarding the conversion of austenite into ferrite-pearlite. The presence of Mo promotes the bainitic transformation occurring during the grain refining and reinforces the hardening action by causing the precipitation of complex carbonitrides. The presence of V reinforces the action exerted by Mn by modifying the structure through the refining of the pearlite grain while improving the elastic limit due to the presence of V in the form of regularly distributed fine precipitated grains. Besides, Nb continues the action of V, notably in the grain refining function. Both V and Nb are used in relatively low amounts to avoid any noxious effect during subsequent operations such as welding. This steel grade is characterized by high mechanical properties and more particularly by a high elastic limit obtained after the thermal treatments disclosed hereinafter.

The following Table I shows the mechanical properties obtained at the end of the above-mentioned cycle of thermal treatments for all the steels included in the specified range of compositions.

TABLE 3

| Mechanical properties | Minimum | Maximum |
|---|---|---|
| R (in Newtons per sq. mm.) | 650 | 700 |
| E (in Newtons per sq. mm.) | 550 | 600 |
| E/R ratio | 0.85 | 0.88 |
| A (percentage) | 18 | 22 |
| Breaking energy measured on a V-notched test bar at −50° C (in joules) | 20 | 25 |
| Breaking energy measured on a V-notched test bar at room temper. (joules) | 80 | 100 |

R = Tensile strength; E = Elastic limit; A = Breaking elongation

The basic principles in the making of high-grade steels in a basic electric arc furnace are well known; however, the casting process according to this invention differs from the conventional sequence of operations in that it is contemplated to produce a deoxidised relatively low-carbon steel for castings substantially free of gas inclusions.

For this purpose, the melt is processed by melting a recarbided batch having a controlled manganese content in the presence of an oxidiser and under lime slag. The melt processing is then completed by injecting gaseous oxygen under a pressure of 600 bars during a time period of the order of 2 mn.

The oxidised slag must be removed in order to ensure a proper phosphor removal (by deslagging).

A synthetic slag is reconstituted by using essentially limestone and fluorspar. A silicon and manganese mixture corresponding to 0.20% Mn by weight is added to fix the carbon content at the desired value at this stage of the process.

A short injection of gaseous oxygen at 600 bars during 55 seconds by using a 21 × 27 mm tube is made 5 mn after reenergizing the furnace. The purpose of this injection is on the one hand to obtain a fluid, gas-free steel melt notwithstanding the stripping during the deslagging step and the addition of limestone, of which it is hardly possible to warrant the subsequent moisture-free condition, and on the other hand to produce a fluid and covering slag which can be activated by adding deoxidisers in powder form, such as silico-calcium products.

Molybdenum is added in the form of ferro-molybdenum, partly into the batch and partly on white slag (i.e. perfectly deoxidised slag) for correcting purposes after obtaining the assay procedure results.

The desired manganese content is obtained by adding gradually increasing amount of silico-manganese and ferro-manganese, with due consideration for the results of rapid assays during the melting process.

Both vanadium and niobium are added in the form of ferro-alloys at the end of the furnace run on a perfectly deoxidised slag, easily known through the fact that a sample picked up by means of a rake and water-quenched as it emerges from the furnace has a very clear, cream-whitish appearance and is then rapidly converted into a powder.

The final deoxidisers, such as aluminium and titanium-aluminium alloy, are added to the casting ladle, the filling of this ladle being so conducted that the steel is delivered first to the ladle (casting temperature = 1,650° C).

This A run assayed as follows (the values are given in percentage by weight, the balance to 100% consisting of iron with the usual impurities):

| C | Mn | Si | S | P | Ni | Cr | Mo | V | Nb | Ti | Al |
|---|---|---|---|---|---|---|---|---|---|---|---|
| 0.097 | 1.75 | 0.15 | 0.013 | 0.018 | 0.11 | 0.19 | 0.21 | 0.035 | 0.029 | 0.024 | 0.031 |

DESCRIPTION OF THE PREFERRED EMBODIMENTS

EXAMPLE 1

A casting run A was performed in a basic-arc electric furnace having a capacity of 3 tons.

The following mechanical properties have been obtained by using a test bar cast vertically and having a cross-section of 40 × 40 mm, after the above-mentioned thermal treatment:

TABLE II

| | | | |
|---|---|---|---|
| Homogenization treatment | 950° C | 950° C | 950° C |
| AC = cooling in calm atmosphere | 2 hr | 2 hr | 3 hr |
| | 5 h AC | 5 h AC | 5 h AC |
| Water quenching at room temperature | 925° C | 925° C | 925° C |
| | 1 h | 1 h | 1 h |
| | 5 h water | 5 h water | 5 h water |
| Tempering | | 600° C | 650° C |
| | | 3 h | 3 h |
| | | 4 h | 4 h |

| Mechanical properties of the steel | Just after quenching | After a complete cycle | After a complete cycle |
|---|---|---|---|
| *Breaking or tensile strength (R) | 760 | 675 | 650 |
| *Elastic limit (E) | 654 | 606 | 581 |
| E/R ratio | 0.86 | 0.90 | 0.895 |
| Ultimate elongation (%) | 15 | 20 | 23 |
| Constriction (%) | 43.5 | 68.6 | 70.6 |
| Brinell hardness | 230 | 208 | 196 |
| **Breaking energy at room temp. | 98 | 128 | 139 |
| **Breaking energy at −50° C | 33.2 | 34.4 | 35.9 |

*R and E are expressed in newtons per sq.mm. (N/mm²)
**Breaking energy measured on a V-notched test bar, in joules.

TABLE III

| | Cycle 1 | Cycle 2 | Cycle 3 |
|---|---|---|---|
| Homogenisation treatment | 950° C | 950° C | 950° C |
| AC = cooling in calm atmosphere | 2 h | 2 h | 2 h |
| | 5 h AC | 5 h AC | 5 h AC |
| Water quenching at room temperature | 925° C | 925° C | 925° C |
| | 1 h | 1 h | 1 h |
| | 5 h water | 5 h water | 5 h water |
| Tempering | without | 600° C | 650° C |
| | | 3 h | 3 h |
| | | 4 h AC | 4 h AC |

| Mechanical properties | Cycle 1 just after quenching | Cycle 2 tempered at 600° C | Cycle 3 tempered at 650° C |
|---|---|---|---|
| *Tensile strength (R) | 815 | 765 | 720 |
| *Elastic limit (E) | 653 | 675 | 658 |
| E/R ratio | 0.80 | 0.88 | 0.91 |
| Breaking elongation % | 14 | 20 | 21 |
| Constriction % | 42 | 65 | 66 |
| Brinell hardness | 252 | 239 | 225 |
| **Breaking energy: at room temperature | 56 | 82 | 98 |
| at −50° C | 16 | 30 | 42 |

*R and E in newtons per sq.mm.(N/mm²)
**Breaking energy measured on a V-notched test bar, in joules.

EXAMPLE 2

Another casting run B performed under similar conditions yields a steel having the following composition, the values being in percentage by weight, the balance to make 100% consisting of iron with the usual impurities:

| | | | |
|---|---|---|---|
| C = 0.111 | Mn = 1.47 | Mo = 0.26 | Si = 0.32 |
| V = 0.046 | Nb = 0.013 | S = 0.016 | P = 0.019 |

-continued

| | | | |
|---|---|---|---|
| Ni = 0.23 | Cr = 0.15 | Ti = 0.004 | Al = 0.033 |

The following mechanical properties of this steel have been obtained by using a vertically cast test bar having a cross-section of 40 × 40 mm, after the thermal treatment cycles mentioned in the foregoing:

The above values characterizing the various mechanical properties prove that the cast steel according to the present invention is remarkable from different points of view, i.e. =:

1. high elastic limit,
2. high E/R ratio,
3. very satisfactory breaking energy measured on a V-notched test bar, even at −50° C, which is a very low temperature for structural steel, and
4. very low difference between the hardness after the water-quenching and that measured after tempering.

This last-mentioned characteristic is extremely propitious as far as weldability is concerned. In fact, equivalent elasticity properties obtained with a moderately alloyed steel would lead to a necessary quencheability of the steel that would imply a high hardness region in the area thermally affected by the welding operation. This area hardened under the weld seams is mainly responsible for the fragility of welded constructions and makes necessary in most instances a suitable heat treatment.

In constrast thereto, one of the desired properties of the steel grade obtainable with the present invention is that no appreciable increment in the hardness appears under the weld seams when using the cast steel of this invention.

Other tests were made and prove that the cast steel according to this invention meet completely the conventional weldability tests.

I. — THICKENING OR STRENGTHENING TESTS

No cracks develop during the test consisting in bending the thickened metal, in contrast to what is observed with a more strongly alloyed steel having equivalent mechanical properties, notably the elastic limit.

II. — IMPLANTS TEST OF THE INSTITUT DE SOUDURE OF PARIS, FRANCE

A test bar cast from the steel of this invention passed this test successfully; an implant stressed under 550 N/mm² did not show any trace of cracks.

III. — MECHANICAL PROPERTIES OF A WELDED ASSEMBLY OF STEEL ACCORDING TO THE INVENTION

The following mechanical results have been obtained during a practical test.

— Traction test a. Through weld and base metal:

| | |
|---|---|
| Breaking strength (R) | 705 N/mm² |
| Elastic limit (E) | 603 N/mm² |
| Breaking elongation (A) | 18 % |
| Constriction (ε) | 65 % |

b. In the weld:

| | |
|---|---|
| Breaking strength (R) | 739 N/mm² |
| Elastic limit (E) | 629 N/mm² |
| Breaking elongation (A) | 19 % |
| Constriction (ε) | 46 % |

c. In the base metal:

| | |
|---|---|
| Breaking strength (R) | 714 N/mm² |
| Elastic limit (E) | 631 N/mm² |
| Breaking elongation (A) | 20 % |
| Constriction (ε) | 70 % |

d. Breaking energy measured in a V-notched test bar at −50° C, lowest value recorded:

| | | |
|---|---|---|
| — | Thermally affected area (TAA) | 24 Joules |
| — | In the weld (added metal) | 44 Joules |
| — | In the base metal | 26 Joules |

All the above results were obtained by using "rough-welded" test samples, i.e. without any subsequent thermal treatment.

The chief advantage arising from the use of this new heat-treated steel grade may be summarized as follows:

The mechanical properties are amply sufficient to enable the steel to withstand service stresses, notably under low temperatures;

The ductility properties are such that the shaping of parts can be contemplated under normal maintenance conditions in actual service, and The good weldability permits not only the manufacture of welded assemblies but also many repairs or the remetalling or thickening of parts during actual service without requiring particular cares.

The industrial and commercial applications of the cast steel of this invention are very numerous. Besides, the high elastic limit, the high E/R ratio and the satisfactory weldability are suitable not only for unitary constructions but also for the manufacture of welded assemblies in which it is desired to preserve important mechanical and ductility properties in conjunction with a reliable weldability. Among the large range of possible applications of the cast steel according to this invention, the following ones may be cited by way of example:

Publicworks machines and equipments;
Shipbuilding materials and structures;
Motor industry equipments;
Railway equipments, notably automatic couplings of the one-piece or welded type for railway cars and waggons.

What is claimed as new is:

1. High elastic-limit weldable molded steel characterized in that it has the following composition in percentage by weight: carbon 0.09 to 0.15, manganese 1.30 to 1.80, molybdenum 0.15 to 0.35, silicon 0.10 to 0.40, vanadium 0.03 to 0.06, niobium or tantalum 0.005 to 0.05, aluminium 0.015 to 0.050, titanium 0.002 to 0.040, nickel 0.10 to 0.30, chromium 0.10 to 0.25, sulphur ≤ 0.020 and phosphorus ≤ 0.030, the balance to make 100% consisting essentially of iron, that it has undergone a cycle of heat treatments including a high-temperature homogenization, a water quenching and a tempering steps, and that it has a very finely grained microstructure consisting of low-carbon bainite and ferrite hardened by the presence of fine precipitates of complex carbonitrides, notably molybdenum, vanadium and niobium or tantalum carbonitrides, said molded steel having in conjunction with a good weldability an elastic limit greater than or equal to 550 N/mm², an elastic-limit to tensile strength ratio greater than 0.85 and a breaking energy at −50° C, measured on a V-notched test bar, greater than or equal to 20 Joules.

2. Molded steel according to claim 1, characterized in that its composition comprises in percentage by weight: carbon, 0.09 to 0.15; manganese, 1.30 to 1.80; molybdenum, 0.15 to 0.25; silicon, 0.10 to 0.35; vanadium, 0.03 to 0.05; niobium, 0.025 to 0.05; aluminium, 0.020 to 0.050; titanium, 0.020 to 0.040; nickel, 0.10 to 0.30; chromium 0.10 to 0.25; sulphur ≤ 0.020 and phosphorus ≤ 0.020, the balance to make 100% consisting essentially of iron.

3. Molded steel according to claim 2, characterized in that its composition comprises in percentage by weight: carbon, 0.097; manganese, 1.75; molybdenum, 0.21; silicon, 0.15; vanadium, 0.035; niobium, 0.029; sulphur, 0.013; phosphorus: 0.018; nickel, 0.11; chromium, 0.19; titanium, 0.024; aluminium, 0.031, the balance to 100% consisting of iron and the usual impurities.

4. Molded steel according to claim 1, characterized in that its composition comprises in percentage by weight: carbon, 0.09 to 0.12; manganese, 1.45 to 1.60; molybdenum, 0.25 to 0.35; silicon, 0.25 to 0.40; vanadium 0.035 to 0.055; niobium, 0.005 to 0.015; aluminium, 0.015 to 0.035; titanium, 0.002 to 0.010; nickel, 0.20 to 0.30; chromium 0.10 to 0.15; sulphur ≤ 0.020 and phosphorus ≤ 0.030, the balance to make 100% consisting essentially of iron.

5. Molded steel according to claim 4, characterized in that its composition comprises in percentage by weight: carbon, 0.111; manganese, 1.47; molybdenum, 0.26; silicon, 0.32; vanadium, 0.046; niobium, 0.013; sulphur, 0.016; phosphorus, 0.019; nickel, 0.23; chromium, 0.15; titanium, 0.004; aluminium, 0.033; the balance to make 100% consisting essentially of iron with the usual impurities.

6. Molded steel according to claim 1, characterized in that said cycle of heat treatments comprises a homogenization treatment conducted at a temperature of 900° to 1,050° C, the temperature increment time and temperature holding time corresponding to a few hours; a water quenching at room temperature after heating during about one hour at a temperature of 875° to 950° C, the temperature increment time being of the order of a few hours; and eventually tempering at a temperature in the range of 550° to 680° C, the temperature increment time and the temperature holding time being of the order of a few hours.

* * * * *